US007779747B2

(12) United States Patent
Myers

(10) Patent No.: US 7,779,747 B2
(45) Date of Patent: Aug. 24, 2010

(54) ACTUATOR AND METHOD FOR PRODUCING MECHANICAL MOTION

(75) Inventor: Jeffrey Lynn Myers, Madison Township, OH (US)

(73) Assignee: General Electric Company, Schenectady, NY (US)

( * ) Notice: Subject to any disclaimer, the term of this patent is extended or adjusted under 35 U.S.C. 154(b) by 343 days.

(21) Appl. No.: 11/965,310

(22) Filed: Dec. 27, 2007

(65) Prior Publication Data

US 2009/0165639 A1 Jul. 2, 2009

(51) Int. Cl.
*F01B 19/04* (2006.01)
*F15B 21/04* (2006.01)

(52) U.S. Cl. ..... 92/92; 92/81

(58) Field of Classification Search ..... 92/81, 92/89, 90, 91, 92, 142; 60/473
See application file for complete search history.

(56) References Cited

U.S. PATENT DOCUMENTS 5,586,482 A 12/1996 Leonard
6,012,287 A 1/2000 Sims
6,666,127 B2 * 12/2003 Peles ..... 92/90
6,868,773 B2 3/2005 Davis et al.
7,194,991 B2 3/2007 Lou
7,246,524 B1 7/2007 Kholwadwala et al.
2003/0205045 A1 11/2003 Peles
2004/0089090 A1 5/2004 Maeda
2006/0037467 A1 * 2/2006 McCarroll et al. ..... 91/361
2007/0129653 A1 6/2007 Sugar et al.
2007/0181709 A1 8/2007 Lee
2007/0262847 A1 11/2007 Grabinger et al.

OTHER PUBLICATIONS

International Search Report, PCT/US2008/081856, dated Jan. 12, 2009, pp. 3.

* cited by examiner

*Primary Examiner*—Michael Leslie
(74) *Attorney, Agent, or Firm*—William Scott Andes, Esq.; Armstrong Teasdale LLP

(57) ABSTRACT

A system for producing mechanical motion is provided. The system includes an actuator having a first end, a second end, and a radially expandable bladder assembly extending therebetween, and a source of pressurized fluid external to said actuator. The bladder assembly further includes an inner cavity. In addition, a substantially fixed-volume reservoir positioned within the cavity is provided, wherein the bladder assembly is configured to expand in a radial direction and contract in an axial direction when a volume of fluid is introduced from the reservoir into the inner cavity.

20 Claims, 3 Drawing Sheets

ACTUATOR AND METHOD FOR PRODUCING MECHANICAL MOTION

BACKGROUND OF THE INVENTION

The field of the invention relates generally to fluidic actuators, and more specifically, to fluidic actuators that contain an internal source of pressurizing fluid.

At least some known types of fluidic actuators use pressurized fluids to produce mechanical motion. For example, known piston-cylinder drives include a piston that moves within the chamber of a cylinder. More specifically, a differential in fluid pressure across the piston causes mechanical displacement of the piston, such as occurs in air cylinder drives and hydraulic rams, for example. Although such actuators may have a relatively long stroke, such actuators may be limited in the force applied to the fluid pressure across the piston by the surface area of the piston.

To produce mechanical motion, at least some other known fluidic actuators simulate the action of natural muscle contraction. For example, in some known actuators, an elastic tube or bladder is surrounded by a sleeve or sheath of relatively stiff, yet flexible material such that an inner bladder is defined between the sleeve and the tube. The two ends of the sheath/tube apparatus can then be connected by end fixtures to other mechanical structures. For example, the sheath/tube apparatus may be connected within an aircraft control system behind the rearmost wing spar to facilitate moving the aircraft control surfaces between extended and retracted positions for varying the lift or drag of the wing. When a pressurized fluid, such as air or hydraulic fluid, is supplied into the inner bladder, a pulling force may be induced axially in the tube as a result of the expansion of the tube. The pulling force forces the surrounding sheath outward and draws the two ends of the actuator closer together. Moreover, a resultant tensile force is then applied to structures attached to the actuator. However, the internal space created by the expansion of the actuator as a result of the pressurization requires an additional volume of compressed gas to be supplied in order to continue to actuate the device.

BRIEF DESCRIPTION OF THE INVENTION

In one aspect, an actuator is provided that includes a first end, an opposite second end, and a bladder assembly extending between the first and second ends. The bladder assembly includes an inner cavity further including a substantially fixed-volume reservoir defined within the cavity, the bladder assembly is expandable when fluid is supplied from said reservoir into the cavity.

In another aspect, a system for producing mechanical motion is provided. The system includes an actuator having a first end, a second end, and a radially expandable bladder assembly extending therebetween, and a source of pressurized fluid external to said actuator. The bladder assembly further includes an inner cavity. In addition, a substantially fixed-volume reservoir positioned within the cavity is provided, wherein the bladder assembly is configured to expand in a radial direction and contract in an axial direction when a volume of fluid is introduced from the reservoir into the inner cavity.

In yet another aspect, a method for producing mechanical motion is provided. The method includes fabricating an actuator comprising a first end, a second end and a bladder assembly extending therebetween, wherein the bladder assembly further includes an inner cavity, and positioning a substantially fixed-volume reservoir within the cavity, wherein the bladder assembly is configured to expand when at least a portion of a fluid stored in the reservoir is channeled into the cavity.

DETAILED DESCRIPTION OF THE INVENTION

Figure 1:
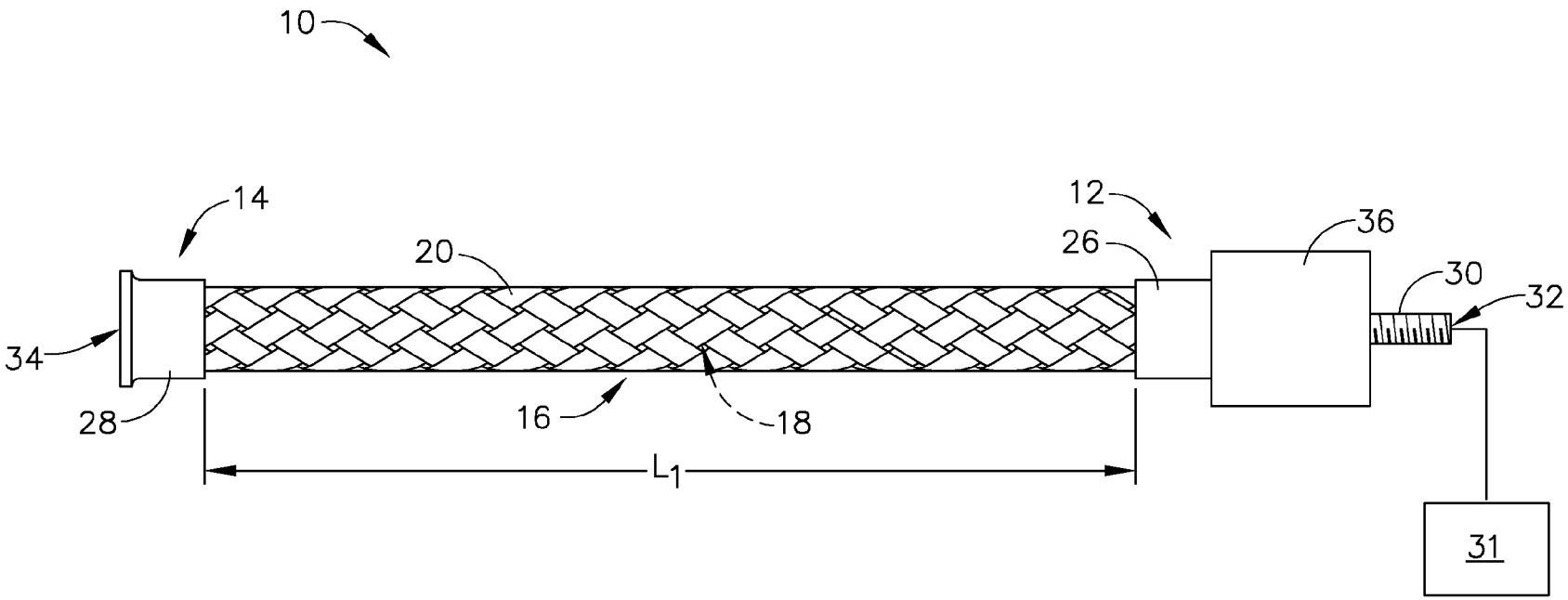
FIG. 1 is a perspective view of an exemplary fluidic actuator and shown uninflated.
Figure 2:
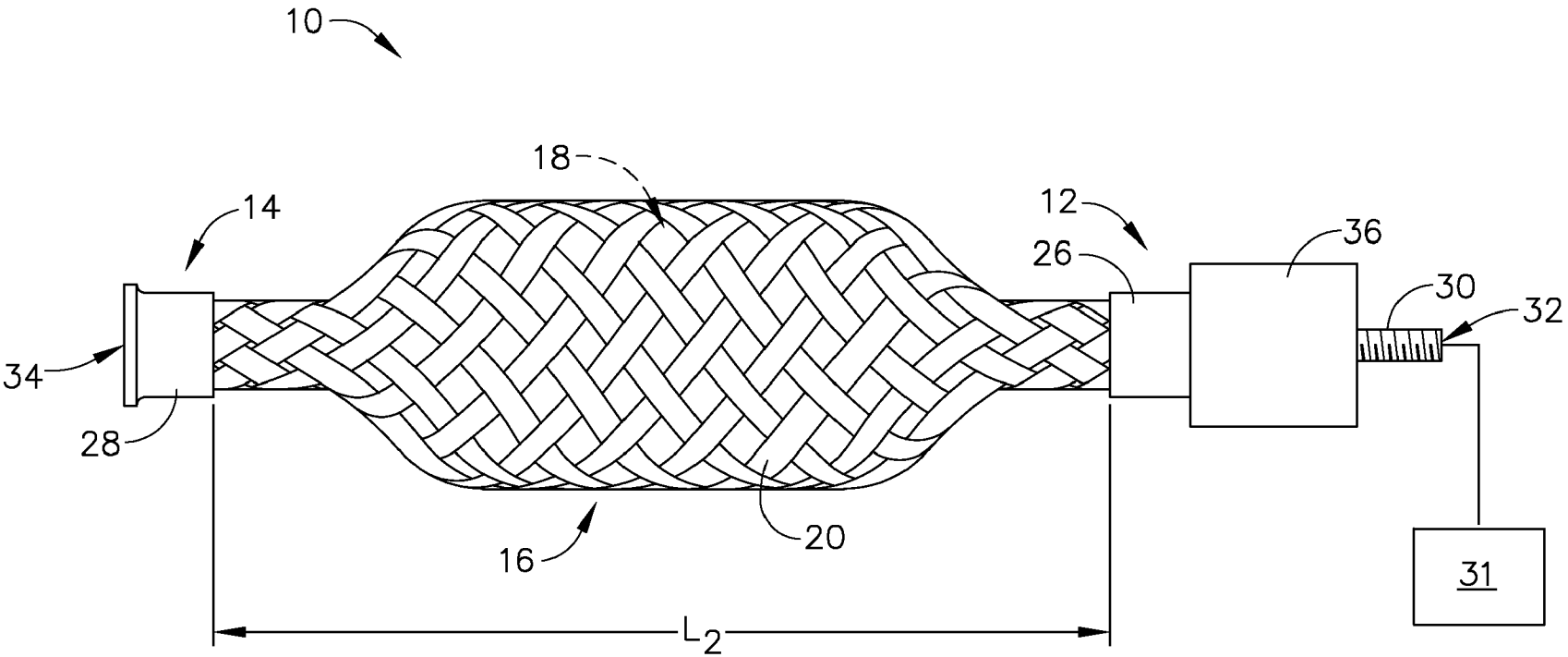
FIG. 2 is a perspective view of the fluidic actuator shown in FIG. 1 and shown pressurized.
Figure 3:
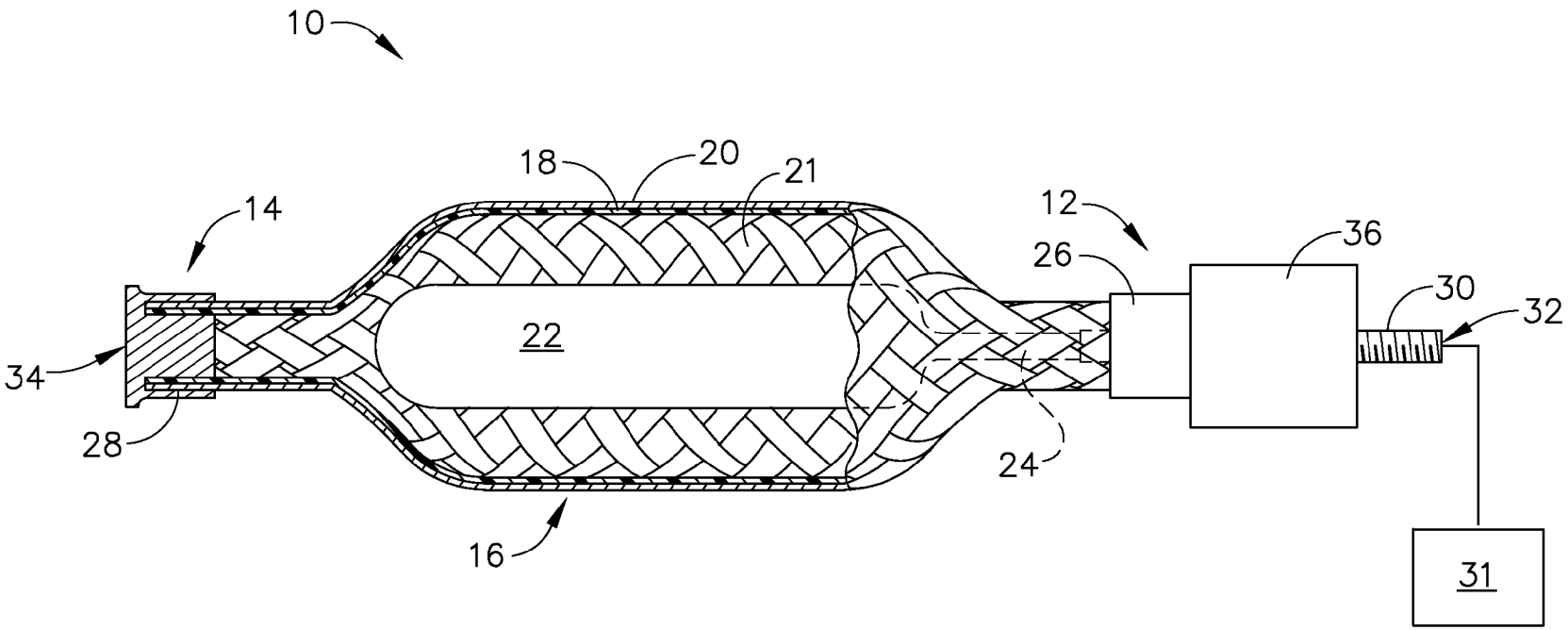
FIG. 3 is a partial cut-away view of fluidic actuator shown in FIG. 1.

Referring to FIGS. 1-3, FIG. 1 is a perspective view of an exemplary actuator 10 shown uninflated, FIG. 2 is a perspective view of actuator 10 and shown pressurized, and FIG. 3 is a partial cut-away view of actuator 10. In the exemplary embodiment, actuator 10 is a fluidic actuator that includes a first end 12, an opposite second end 14, and an expandable bladder assembly 16 therebetween. Bladder assembly 16 also includes a tube 18 and a casing 20 that defines an inner cavity 21. Alternatively, tube 18 may be any elastic hose capable of expansion as described herein, and casing 20 may be any braided, relatively stiff sheath that enables the actuator 10 to function as described herein. Moreover, in an alternative embodiment, bladder assembly 16 may include any tube-like structure to enable actuator 10 to function as described herein.

In the exemplary embodiment, a fluid reservoir 22 is defined within inner cavity 21. More specifically, fluid reservoir 22 is a fixed-volume, substantially cylindrical reservoir. Alternatively, fluid reservoir 22 may be any elongated reservoir or tank that enables a volume of fluid to be stored under pressure and that enables actuator 10 to function as described herein. Reservoir 22 is coupled in flow communication with actuator first end 12 by an internal conduit 24. During operation, as described in more detail below, compressed fluid is channeled through conduit 24 from reservoir 22 into cavity 21. The introduction of such fluid causes actuator 10 to expand axially and contract radially.

End fittings 26 and 28 are coupled to actuator first end 12 and second end 14 of bladder assembly 16, respectively. In the exemplary embodiment, first end fitting 26 includes a connector 30 that enables a mechanical structure (not shown) to couple to actuator first end 12. For example, actuator 10 may be connected within an aircraft control system behind the rearmost wing spar to facilitate moving the aircraft control surfaces between extended and retracted positions for varying the lift or drag of the wing. Additionally, connector 30 includes a fluid line 32 that enables reservoir 22 to be filled and unfilled via conduit 24 with fluid from an external source 31, as well as venting fluid from bladder assembly 16. In the exemplary embodiment, reservoir 22 is coupled to fluid line 32 via conduit 24. Moreover, second end fitting 28 includes a connector 34 that enables a mechanical structure (not shown) to couple to actuator second end 14. In addition, fitting 28 facilitates closing and sealing second end 14. In an alternative embodiment, second end fitting 28 may include a fluid transfer line (not shown).

In the exemplary embodiment, actuator first end 12 includes a control manifold 36 that controls an operating pressure and a flow rate of fluid within bladder assembly 16. Specifically, control manifold 36 directs the flow of fluid from reservoir 22 into bladder assembly cavity 21. Additionally, control manifold 36 facilitates reducing the operating pressure within bladder assembly 16 by venting the fluid from bladder assembly 16 to the atmosphere through fluid line 32. Furthermore, control manifold 36 is configured to facilitate wireless communication with an external controller (not shown), such that, in the exemplary embodiment, control manifold 36 is wireless and may be programmed to operate autonomously or by commands from the external controller. Additionally, control manifold is also configured to contain a power source (not shown) such that no electrical connections are required. Alternatively, control manifold may be controlled by any source and be powered by any means that enables actuator 10 to function as described herein.

In the exemplary embodiment, actuator 10 is a wireless, self-contained system, including actuator 10 and reservoir 22. Control manifold 36 facilitates venting of fluid from cavity 21 to the atmosphere through fluid line 32. Following release of the fluid from bladder assembly 16 to the atmosphere, actuator 10 is returned to the uninflated configuration and expands axially and contracts radially, and reservoir 22 is recharged with fluid from external source 31 through fluid line 32 and maintained by control manifold 36, as described herein. Alternatively, actuator 10 can include any such connector and external fluid source that enables actuator 10 to function as described herein.

In operation, actuator 10 facilitates movement of two mechanical structures (not shown) relative to one another. For example, actuator 10 can be coupled within an aircraft emergency control system in the case of post-hydraulic failure, or actuator 10 can be coupled within an aircraft control system behind the rearmost wing spar to facilitate moving an aircraft control surface, such as an aileron, rudder or elevator, between extended and retracted positions for varying the lift and/or drag on the control surface. As illustrated in FIG. 1, when uninflated, actuator 10 has a length, $L_1$. In the exemplary embodiment, actuator 10 is coupled to the mechanical structures via connectors 30 and 34. To cause movement of the two structures, control manifold 36 directs a pre-determined amount of fluid from fluid reservoir 22 via conduit 24 into bladder assembly cavity 21. This transfer of fluid causes bladder assembly 16 to inflate radially outward, as is illustrated in FIGS. 2 and 3. In the exemplary embodiment, as bladder assembly 16 inflates, bladder assembly 16 contracts axially until bladder assembly 16 has a length $L_2$. In the exemplary embodiment, length $L_1$ is longer than length $L_2$. More specifically, the contraction causes actuator first end 12 and second end 14 to be drawn towards each other in axially. As such, mechanical structures coupled to connectors 30, 34 are moved closer to each other after inflation of activator 10. For example, actuator 10 can be used in robotics to resemble a human muscle, such that connectors 30, 34 serve as "tendons" to connect the actuator 10 to structure on both sides of a robotic joint.

The above described methods and systems facilitate producing mechanical motion. More specifically, the methods and systems described herein use an internal fluid pressurizing system thereby reducing the amount of compressed fluid needed to operate such actuators. As such, actuator 10 serves as a self-contained fluidic actuator that may be used, for example, in aircraft control systems (i.e. as control surface actuators, within a shock absorption system for crash survival, or as a secondary control for post-hydraulic failure), or in the robotics industry replicating the motion and movement of a human muscle. Moreover, control manifold enables wireless control over the flow of fluid between the reservoir, bladder assembly cavity and atmosphere, and may be completely autonomous with respect to electrical power and activation. Additionally, the system and methods described herein increase the overall efficiency of the actuator in comparison to those systems supplied with pressurizing fluid from an external source.

Although the apparatus and methods described herein are described in the context of actuators that use pressurized fluids to produce mechanical motion, it is understood that the apparatus and methods are not limited to self-contained fluidic actuators. Likewise, the system components illustrated are not limited to the specific embodiments described herein, but rather, system components can be utilized independently and separately from other components described herein.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

While the invention has been described in terms of various specific embodiments, those skilled in the art will recognize that the invention can be practiced with modification within the spirit and scope of the claims.

What is claimed is:

1. An actuator for use in producing mechanical motion, said actuator comprising:

a first end;

an opposite second end; and a bladder assembly extending between said first and second ends, said bladder assembly comprising an inner cavity comprising a substantially fixed-volume reservoir defined within said cavity, said bladder assembly expandable when fluid is supplied from said reservoir into said cavity.

2. An actuator in accordance with claim 1, wherein said bladder assembly is configured to receive a flow of pressurized fluid.

3. An actuator in accordance with claim 1, further comprising a control manifold coupled to one of said first end and second end, said control manifold configured to control an operating pressure and a flow rate of fluid supplied to said cavity.

4. An actuator in accordance with claim 1, wherein said bladder assembly further comprises an inner tube and an outer casing, said outer casing is less flexible than said inner tube.

5. An actuator in accordance with claim 1, wherein at least one of said first end and said second end further comprises a coupling configured to couple said actuator to a mechanical structure.

6. An actuator in accordance with claim 1, wherein said reservoir is configured to couple to a source of pressurized fluid that is selectively in flow communication with the reservoir.

7. An actuator in accordance with claim 1, wherein said bladder is configured to expand radially when the fluid is supplied to said cavity.

8. An actuator in accordance with claim 3, wherein said control manifold is configured to be controlled wirelessly, said control manifold further configured to operate autonomously.

9. A system for producing mechanical motion, said system comprising:

an actuator comprising:

a first end, a second end, and a radially expandable bladder assembly extending therebetween, the bladder assembly comprising an inner cavity;

a substantially fixed-volume reservoir positioned within the cavity wherein the bladder assembly is configured to expand in a radial direction and contract in an axial direction when a volume of fluid is introduced from the reservoir into the inner cavity; and a source of pressurized fluid external to said actuator.

10. A system in accordance with claim 9, wherein the reservoir is charged by an external fluid source in flow communication with the reservoir.

11. A system in accordance with claim 9, further comprising a control manifold coupled to at least one of the first end and second end, said control manifold configured to control a pressure within and a flow rate of at least a portion of said volume of fluid into said cavity.

12. A system in accordance with claim 9, wherein the bladder assembly further comprises an inner, expandable tube and an outer, relatively stiffer casing.

13. A system in accordance with claim 9, wherein at least one of the first end and the second end further comprise attachment fixtures configured to affix mechanical structures thereto.

14. A system in accordance with claim 9, wherein the reservoir further comprises a fluid under pressure.

15. A system in accordance with claim 9, wherein the bladder is configured to contract in the radial direction and expand in the axial direction when the fluid is vented from the cavity.

16. A method for producing mechanical motion comprising:

fabricating an actuator comprising a first end, a second end and a bladder assembly extending therebetween, wherein said bladder assembly comprises an inner cavity; and positioning a substantially fixed-volume reservoir within the cavity, wherein the bladder assembly is configured to expand when at least a portion of a fluid stored in the reservoir is channeled into the cavity.

17. A method in accordance with claim 16, further comprising introducing a volume of fluid from the reservoir into the cavity, such that the bladder assembly such that when the bladder assembly expands in the radial direction, the first end and second end are drawn towards each other in the axial direction.

18. A method in accordance with claim 16, where in fabricating an actuator further comprises coupling attachment fixtures to the first end and the second end.

19. A method in accordance with claim 16 further comprising coupling a manifold to one of the first end and second end, the control manifold configured to control a pressure and a flow rate of said fluid supply within the cavity.

20. A method in accordance with claim 16, further comprising venting the fluid from the cavity such that the bladder contract in a radial direction and expands in an axial direction.

* * * * *